United States Patent [19]

Patonay et al.

[11] Patent Number: 4,602,193

[45] Date of Patent: Jul. 22, 1986

[54] METHOD AND APPARATUS FOR THE STABILIZATION OF DIRECT CURRENT ARC LAMPS

[75] Inventors: Gabor Patonay, Decatur; Isiah M. Warner, Stone Mountain; Philip B. Oldham, Atlanta, all of Ga.

[73] Assignee: Emory University, Atlanta, Ga.

[21] Appl. No.: 639,383

[22] Filed: Aug. 10, 1984

[51] Int. Cl.[4] ..... H05B 37/00; H05B 39/00

[52] U.S. Cl. ..... 315/170; 307/43; 315/175; 315/176; 356/313; 356/323

[58] Field of Search ..... 315/170, 171, 172, 174, 315/175, 176, 291; 356/313, 323; 307/43, 44

[56] References Cited

U.S. PATENT DOCUMENTS

| | | | |
|---|---|---|---|
| 3,066,243 | 11/1962 | Mutschler | 315/176 |
| 3,102,971 | 9/1963 | Cuadra et al. | 315/176 X |
| 3,624,447 | 11/1971 | Young et al. | 315/176 |
| 3,653,766 | 4/1972 | Walters | 356/313 |
| 3,869,643 | 3/1975 | Okagaki | 315/174 |
| 4,055,783 | 10/1977 | Walters et al. | 356/313 |
| 4,362,971 | 12/1982 | Sloan, Jr. | 315/176 |

*Primary Examiner*—Saxfield Chatmon

*Attorney, Agent, or Firm*—Oblon, Fisher, Spivak, McClelland & Maier

[57] ABSTRACT

A system for stabilizing the arc in a DC arc lamp. An AC signal is superimposed on the DC power source of the lamp to cause small regular fluctuations in the arc. The small fluctuations prevent large fluctuations while the small regular fluctuations may be averaged to obtain a constant average value. The average is taken over 5 to 10 periods of the AC signal to produce a constant average signal with a very small standard deviation.

16 Claims, 6 Drawing Figures

METHOD AND APPARATUS FOR THE STABILIZATION OF DIRECT CURRENT ARC LAMPS

This invention was made with Government support under contract N0014-83-K-0026 awarded by the Department of the Navy. The Government has certain rights in the invention.

BACKGROUND OF THE INVENTION

1. Field of the Invention

This invention relates generally to a stabilizing system for an arc lamp and more particularly to a system for superimposing an AC signal on the DC power source of an arc lamp and averaging the light output.

2. Description of the Prior Art

In certain areas of scientific research, such as optical spectroscopy, direct current high pressure arc lamps are routinely used to provide a high intensity broad band illuminator source. However, for these applications, it is very important to have a constant optical intensity. Since arc lamps suffer from the problems of power instability and arc wander, their use has been somewhat limited. Various designs over the last 20 years have addressed the problem or current regulation and have proved adequate in regulating the lamp current. One example of this is shown in U.S. Pat. No. 4,382,210.

On the other hand, the problem of arc wander or fluctuation has not been solved. While this phenomenon is not yet completely understood, it is clear that it is not a function of the power stability. The current theory indicates that the heat flux directed toward the anode produces abnormalities in the surface of the electrode which cause the arc to wander.

Several attempts have been made to overcome this problem, including the use of feedback to adjust the current and the application of a magnetic field (see U.S. Pat. No. 3,988,626). The effect of modulation frequency on the arc has also been examined. Other devices, shown in U.S. Pat. Nos. 3,365,564 and 2,629,071 involve AC signals used in arc welding applications, but are not designed to produce an optically stable light source. While these attempts have produced some improvement in arc stability, they do not produce a stable enough optical intensity for many research testing applications.

SUMMARY OF THE INVENTION

Accordingly, one object of this invention is to provide a new and improved stabilizing method and apparatus for an arc lamp.

Another object of this invention is to provide a reliable and accurate stabilizing system for an arc lamp.

A further object of this invention is to provide an arc lamp having a stable output.

A still further object of this invention is to provide a stabilizing system for an arc lamp including an AC source and an averaging technique.

Briefly, these and other objects of the invention are achieved by providing a DC arc lamp with a superimposed AC signal to create regular fluctuations in the optical signal which can be averaged over several periods to obtain a constant output.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
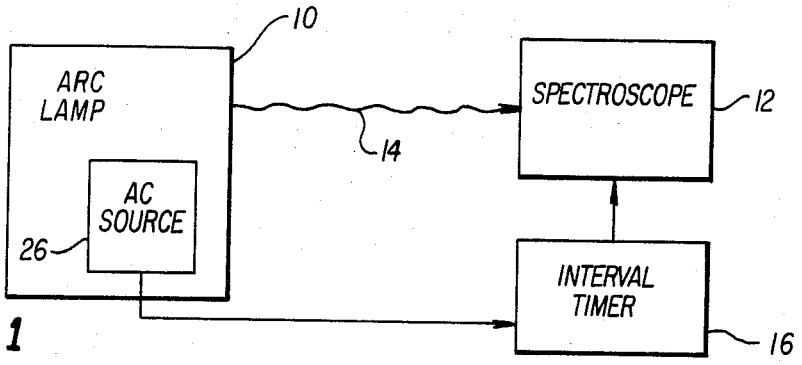
FIG. 1 is a block diagram of the invention.

Referring now to the drawings, wherein like reference numerals designate identical or corresponding parts throughout the several views, and more particularly to FIG. 1 thereof, wherein the overall arrangement of the invention is shown as including an arc lamp 10. The lamp produces a beam of light 14 to be used in a scientific testing instrument such as a spectroscope 12. The light is focused onto a narrow slit (not shown) of the spectroscope. The arc lamp includes an AC power source 26 which will be explained more fully in regard to FIGS. 2–4.

A timing device 16 for controlling the testing period is connected to the spectroscope to determine the beginning and end of a test in the spectroscope. The timer is connected to the output of the AC source so that the test interval may be related to a number of cycles of the AC souce.

Figure 2:
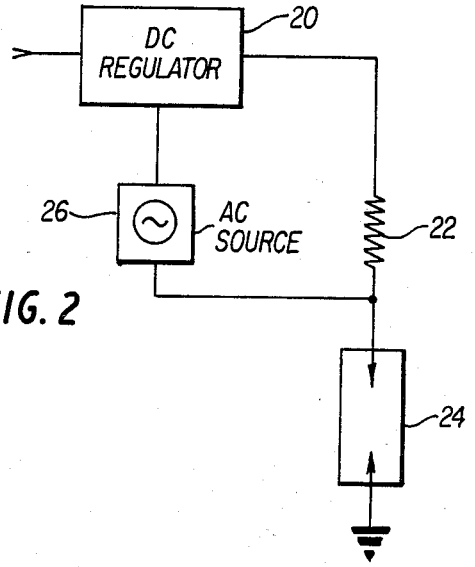
FIG. 2 is a first embodiment of an arc lamp used in the present invention.

FIG. 2 shows a first embodiment of an arc lamp used in the present invention. A conventional DC power source provides current through a resistance 22 to one side of a pair of arc electrodes 24 which create an arc to produce light. The other side of the arc electrode pair is connected to ground. The present invention adds to this conventional circuit an AC source 26 whose alternating current is superimposed on the conventional DC current and is preferably 5–60% of the DC current. The amount of AC current needed in regard to the DC current depends on the instability of the arc. The AC source is connected between the adjustment input of the DC source 20 and the input to the arc electrode so as to superimpose the AC signal on the DC output.

Figure 3:
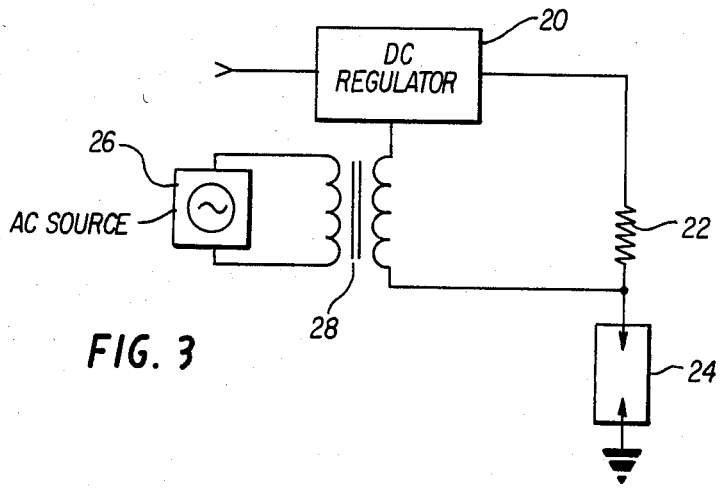
FIG. 3 is a second embodiment of an arc lamp used in the present invention.

In FIG. 3, the same basic circuit for the arc lamp is shown, except for the placement of the AC source. In this embodiment, the AC source is connected by way of a transformer 28 between the same adjustment input of the DC source and the input to the electrodes so that the AC signal is phased into the DC output by way of the transformer.

In operation, the AC current is supplied to the arc at the same time as the conventional DC current. The combined signal produces a regular sinusoidal variation in the voltage across the electrodes with an amplitude and frequency determined by the AC signal. This variation causes the arc instensity to vary in a regular manner with relatively small excursions.

By having the arc intensity to vary, there is little heat build-up at any single point. As a result, irregularities in the electrode surface due to heat are avoided. Large excursions of the arc caused by these irregularities are then also avoided with the result that the arc position becomes much more constant. The arc intensity varies due to the AC current, but it does so in a regular, predictable pattern which has a constant average value.

As the arc wanders, the image of the light which is focused on the slit of the spectroscope no longer is centered on the slit and the light intensity received by the spectroscope varies. Arc wander is practically eliminated by the additional AC current and since the optical output varies by a regular amount in conjunction with the signal from the AC source, the average level of the intensity remains constant. It is important, however, to take the average over several, such as 5–10, full cycles of the AC signal so that one fractional part of a cycle that may be included doesn't unduly affect the average.

As seen the FIG. 1, the length of time taken for the test is determined by timer 16 which is connected to the spectroscope. The timer is also connected to the AC source in the arc lamp. The timer receives the AC signal and may be set to count a number of cycles of the AC signal. Thus, the timer may count, for example, 7 cycles of the AC signal and use this time as the testing interval for the spectroscope.

Of course, other arrangements of the timer are also possible. For example, if the period of the AC signal is known, the timer need not be connected to the AC source, but merely have an independent timing device and be set for the same amount of time. Also, the timer would be an integral part of the spectroscope rather than a separate circuit. The number of cycles to be counted could be adjustable or set for a constant value if desired. The timer need not display the time in cycles, but can use normal units of milliseconds instead.

In order to assess the physical affects on the arc and its optical output by an AC component, the lamp output can be compared with the AC signal superimposed on the lamp. A sine wave of about 200 Hz and 3 V was placed on the DC power. The optical output was attenuated and transmitted by a fiber optic to a photo multiplier tube. A dual trace osciloscope was used to compare the input signal to the signal detected by the photo multiplier tube. The two signals indicate excellent correlation between the input power to the arc and its optical output. This shows that the introduction of an AC signal to the arc actually modulates the optical output intensity.

Figure 4:
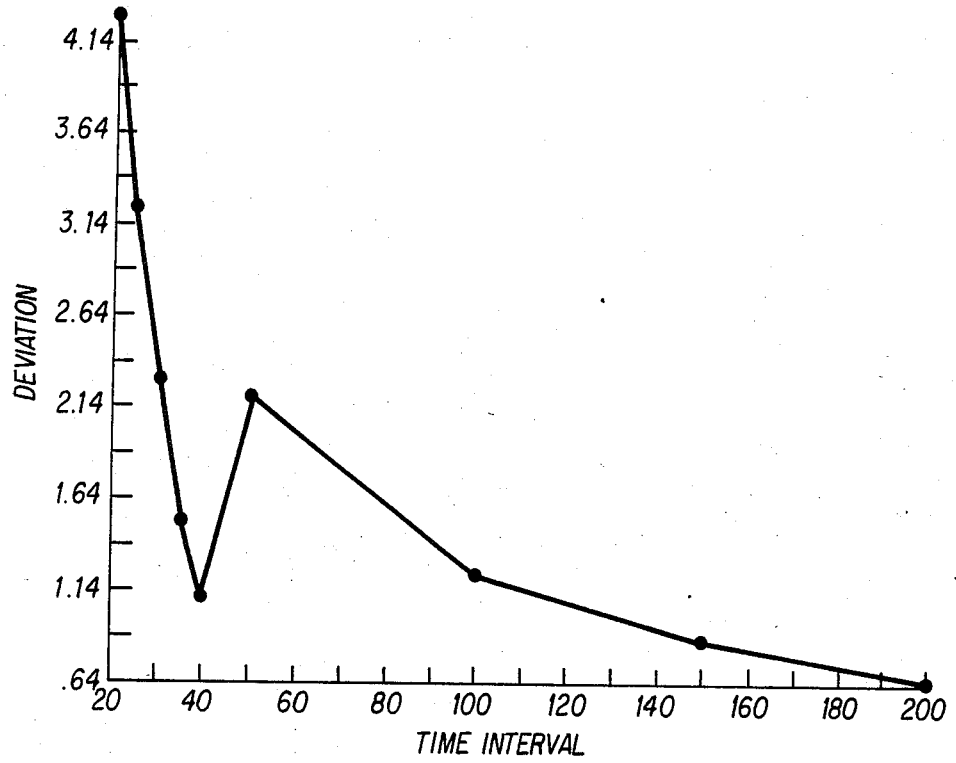
FIG. 4 is a graph showing the level of deviation obtained for various averaging periods.

FIG. 4 is a graph showing the relative standard deviation as a function of the testing interval. The AC signal has a frequency of 25 Hz, hence the period is 40 ms. The X axis of the graph thus extends from $\frac{1}{2}$ of a period to 5 periods. The deviation starts very high and decreases to a point corresponding to one full cycle. The deviation then increases before tapering off as the interval approaches 5 periods. This can be explained by the fact that at less than a full cycle only one side or part of the cycle will have been experienced, hence the signal will be weighted to one side. When exactly one cycle is reached, the weighting will be uniform. As a second cycle is started, the fractional cycle will again weight the average to one side, causing a large deviation. As the total number of cycles increases, the importance of the fraction of a cycle decreases. Experience has shown that by using averages involving 5–10 periods, the deviation reaches an acceptable level, and in fact is considerably lower than the deviation of prior art devices without the AC signal.

Figure 5A:
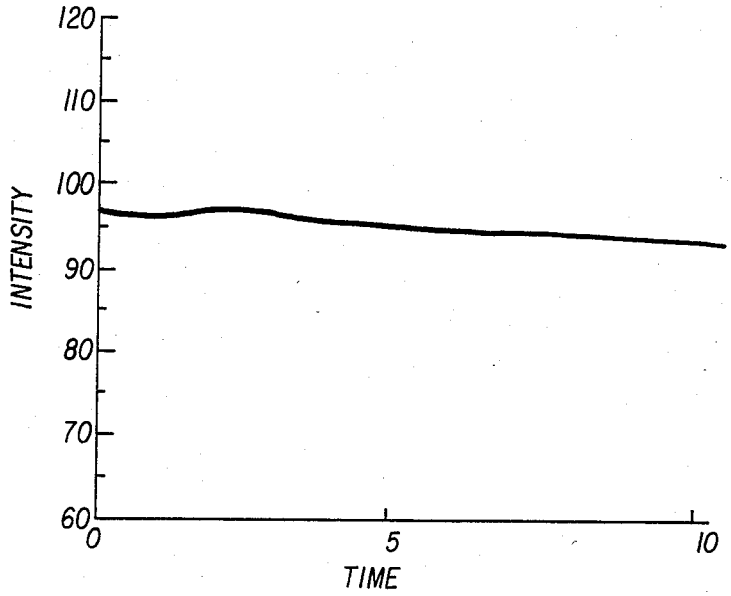
FIGS. 5A and 5B are graphs showing the intensity of an arc lamp with and without the AC source.
Figure 5B:
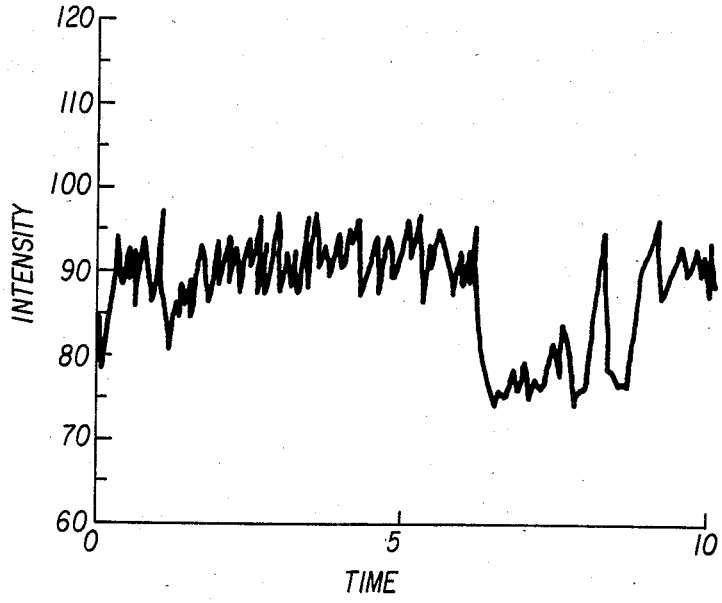

An example of this is show in FIGS. 5A and 5B, where the intensity of the lamp is charted over a period of time for the present invention (FIG. 5A) and for the same device with a stable power supply but without the AC source (FIG. 5B). The intensity in this test was measured using a fluorescence measurement. As is clearly seen, the intensity in FIG. 5A is very constant with a relative standard deviation of only 1.19%. The intensity in FIG. 5B varies considerably with a relative standard deviation of 4.77%. Thus, the deviation is roughly $\frac{1}{4}$ of the deviation without the AC source. Without these large deviations, the average intensity of the arc lamp remains constant enough to be used in scientific testing instruments such as spectroscopes.

While the AC signal has been described as sinusoidal, it could also be any other shape which varies regularly, such as a square wave.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A stabilized DC arc lamp system comprising:

a pair of arc electrodes for producing an arc which gives off light;

a DC current regulator for providing a direct current to said electrodes to provide power to said arc;

an AC current source having a frequency for providing a small alternating current to said electrodes to be superimposed on said DC current to reduce the wander of said arc with small position fluctuations;

an instrument for receiving said light over a time interval;

a timing means for controlling said time interval to be at least as long as several cycles of said AC current source so that the effect of said AC current on the light intensity is minimized.

2. A system according to claim 1 wherein said interval is 5–10 cycles of said AC current source.

3. A system according to claim 1 wherein said AC source is connected between said DC current regulator and the junction of the output of said DC current regulator and a first terminal of said electrodes.

4. A system according to claim 1 wherein said AC source is connected by way of a transformer to a line between said DC current regulator and the junction of the output of said DC current regulator and a first terminal of said electrodes.

5. A system according to claim 1 wherein said AC source is connected by way of a transformer to a line between ground and a second terminal of said electrodes.

6. A system according to claim 1 wherein the wander of said arc causes the light received by the instrument to vary in intensity in a regular manner.

7. A system according to claim 1 wherein the alternating current prevents heat build-up, surface irregularities and large fluctuations in the arc.

8. A system according to claim 1 wherein said instrument is a scientific testing instrument.

9. A system according to claim 8 wherein said scientific testing instrument is a spectroscope.

10. A system according to claim 8 wherein said interval is the length of time for a testing procedure.

11. A system according to claim 1 wherein said timing means is connected to said AC current source.

12. A method for stabilizing a DC arc lamp which is used as a light source for an instrument, comprising the steps of:

superimposing a small AC current having a frequency on a DC arc lamp current to create small regular fluctuations in the arc position, and variation of intensity of the light received by said instrument;

controlling the testing intervals of said instrument to extend over several cycles of said AC current so that the effect of said variation of intensity will be minimized.

13. A stabilized DC arc lamp system having a pair of arc electrodes powered by a DC current regulator for producing an arc which supplies light to a testing instrument, wherein the improvement comprises:

an AC current source for superimposing a small AC current having a frequency onto said DC current to cause said arc to wander in a regular manner with small fluctuations;

a timing means for controlling the testing interval of said instruments to be at least as long as several cycles of said AC current so that the effect of the AC current on the light intensity is minimized.

14. A stabilized DC arc lamp system according to claim 1 wherein the frequency is in the range of 10–500 Hz.

15. A method for stabilizing a DC arc lamp according to claim 12, wherein the frequency is in the range of 10–500 Hz.

16. A stabilized DC arc lamp system according to claim 13, wherein the frequency is in the range of 10–500 Hz.

* * * * *